United States Patent [19]

Vrijssen et al.

[11] Patent Number: 4,961,023

[45] Date of Patent: Oct. 2, 1990

[54] CATHODE RAY TUBE INCLUDING A HELICAL FOCUSING LENS

[75] Inventors: Gerardus A. H. M. Vrijssen; Ronald Van Rijswijk, both of Eindhoven, Netherlands

[73] Assignee: U.S. Philips Corporation, New York, N.Y.

[21] Appl. No.: 408,985

[22] Filed: Sep. 18, 1989

[30] Foreign Application Priority Data

Sep. 21, 1988 [NL] Netherlands ..... 8802333

[51] Int. Cl.[5] ..... H01J 29/46; H01J 29/56

[52] U.S. Cl. ..... 313/456; 313/450

[58] Field of Search ..... 313/417, 450, 451, 456, 313/457, 482

[56] References Cited

U.S. PATENT DOCUMENTS 3,375,390 3/1968 Schlesinger ..... 313/450

3,909,655 9/1975 Grimmett et al. ..... 313/451 X 4,857,797 8/1989 Vrijssen ..... 313/450

*Primary Examiner*—Sandra L. O'Shea

*Attorney, Agent, or Firm*—Robert J. Kraus

[57] ABSTRACT

Cathode ray tube having an electron gun which comprises a beam-shaping part and a focusing structure, which structure comprises a hollow tube with a helical electrically conducting glass-enamel layer on the inner surface. Together with the hollow tube, the components of the beam-shaping part are secured to axial mounting rods via metal supporting elements. The tube has a first and a second end face each of which is fixedly connected in one embodiment to a metal plate having a coaxial opening provided with a flange, which flange projects into the tube and is fused in an electrically conducting manner to the electrically conducting glass-enamel layer of the focusing structure.

10 Claims, 4 Drawing Sheets

CATHODE RAY TUBE INCLUDING A HELICAL FOCUSING LENS

BACKGROUND OF THE INVENTION

The invention relates to a cathode ray tube having an envelope comprising a phosphor screen on one side and a neck portion on the other side, and an electron gun which is positioned in the neck portion and has a beam-shaping part and a focusing structure, said beam-shaping part comprising a cathode and at least one metal electrode, and said focusing structure comprising a hollow tube which is open at both ends and is made of an electrically insulating material with a layer of high-ohmic resistive material on the inner surface.

Such a cathode ray tube is known from EP-A No. 233379. The cathode ray tube described in this Application is provided with an electron gun which comprises a hollow glass tube. In the manufacture the glass tube is softened by heating it and is drawn on an accurately made mandril which changes diameter several times in its longitudinal direction. Supporting faces for the electrodes of the beam-shaping part of the gun are formed on the inside of the tube thus calibrated. The focusing structure is constituted by a layer of high-ohmic resistive material which is provided, for example, in a helical form on the inner wall of the glass tube.

If such a "glass" gun is manufactured in large numbers, it is found that the very accurately made (and hence expensive) mandrils required during manufacture wear rapidly. This is at the expense of the reproducibility. Moreover, it appears to be a problem to make the electrode components to be accommodated in the glass tube in a sufficiently constant shape.

SUMMARY OF THE INVENTION

It is an object of the invention to provide a cathode ray tube of the type described in the opening paragraph with an electron gun which can easily be manufactured in mass production with a satisfactory reproducibility and at relatively low cost.

According to the invention the cathode ray tube of the type described in the opening paragraph is therefore characterized in that the components of the beam-shaping part of the electron gun, together with the hollow tube are secured via metal supporting elements to at least two axial mounting rods, the tube being fixedly connected at each of its end faces to a metal plate having a coaxial opening which is provided with a flange projecting into the hollow tube.

In the construction described above the components of the beam-shaping part are secured to axial mounting rods. The hollow (glass) tube therefore need not provide any supporting faces for the electrodes of the beam-shaping part and may thus be "straight". Therefore, no (rapidly wearing) accurately made mandril for providing supporting faces is required for its manufacture. The hollow tube is fixed to the same mounting rods. A correct alignment of the respective gun components can be ensured by means of a jig.

Different techniques such as:

thermal fusion of the (glass) tube to the metal;

local fusion by means of high-frequency heating can be used for connecting the flanges of the metal plates to the ends of the tube of the focusing structure which may be of, for example glass or ceramic material.

When making such connections, the metal must be fusable and the coefficients of expansion of the material of the tube and the metal should be equal within narrow limits so as to prevent unwanted forces from being exercised on the tube when making the connection.

A combination which is usable in practice is, for example a tube of lead glass and metal plates of FeCr. However, due to its magnetic properties, FeCr is not always desirable in an electron gun.

Another aspect of the above-mentioned connection methods is that they are effected at such temperatures that it is safer to provide the high-ohmic resistive layer after the metal plates have been connected to the ends of the tube. From a processing point of view it is, however, attractive to provide the high-ohmic resistive layer in advance on the inner surface of the hollow tube. Preferably, the flanges of the metal plates are therefore secured to the inner surface of the hollow tube by means of a glass-enamel. This connection technique requires much lower temperatures for realising the connection, as compared with the techniques described above, so that it is possible to provide the high-ohmic resistive layer in the tube in advance without the risk of it being damaged by the later connection process. Moreover the requirements imposed on the conformity of the coefficients of expansion of the tube material and the plate material are less stringent, thus providing an ampler choice in materials to be used. Particularly, non-magnetic plate materials are therefore usable.

A complication, which has not yet been stated, in the manufacture of the electron gun of the known cathode ray tube is that electrical lead-outs through the wall of the tubes have to be made because the electrodes of the beam-shaping part and the resistive layer of the focusing structure are provided on the inner side of one and the same hollow tube. In the construction according to the invention the electrodes of the beam-shaping part are directly connected and the use of metal connection plates with flanges, which are secured by means of glass-enamel in the ends of the hollow tube, provides the possibility of directly connecting the high-ohmic resistive layer to the inner surface.

An embodiment of the cathode ray tube according to the invention is characterized in that the high-ohmic resistive layer on the inner surface of the hollow tube comprises a glass-enamel with an electric resistive material and in that the flange of at least on of the metal plates is secured to the inner surface of the tube by means of said glass-enamel. An electrical connection with the resistive layer may therefore be effected through the metal plate so that a lead-out through the tube wall is not required. Such a construction may advantageously also be used at the other end of the tube.

The use of metal plates of Al or an Al alloy in the above-described glass-enamel connection technique is found to lead to a very good connection, particularly if the plates are thin-walled. The advantage of using thin-walled plates is that they exercise small or negligibly small forces on the hollow tubes. Thin-walled is herein understood to mean particularly a wall thickness between 0.01 and 0.10 mm.

The direct connection of thin-walled (Al) metal plates to the axial mounting rods may present problems in practice in connection with robustness and ease of handling of such plates. To solve these problems, a preferred embodiment of the cathode ray tube according to the invention is characterized in that each metal plate of thin-walled material is mounted between a connection plate and a supporting plate, which plates have openings arranged coaxially with the opening in the relevant metal plate, the flange around the opening of the metal plate projecting through the opening in the supporting plate, and the connection plate being secured to the mounting rods.

In one embodiment each metal plate of thin-walled material is mounted between the supporting plate and the connection plate by means of laser welding.

The construction of the electron gun in the cathode ray tube according to the invention is versatile, i.e. its use is not limited to a monochrome cathode ray tube with an electron gun having a single beam-shaping part and a single focusing structure. The construction may be used to equal advantage in applications in which the beam-shaping part is intended to produce three electron beams and in which either the focusing structure may be common for the three beams or each beam has its own focusing structure. In the latter case each of the three focusing structures may either comprise a tube of an electrically insulating material, or the three focusing structures may be accommodated in one tube with three internal ducts.

BRIEF DESCRIPTION OF THE DRAWING

Some embodiments of the invention will be described in greater detail with reference to the accompanying drawings in which.

DESCRIPTION OF THE PREFERRED EMBODIMENTS

Figure 1:
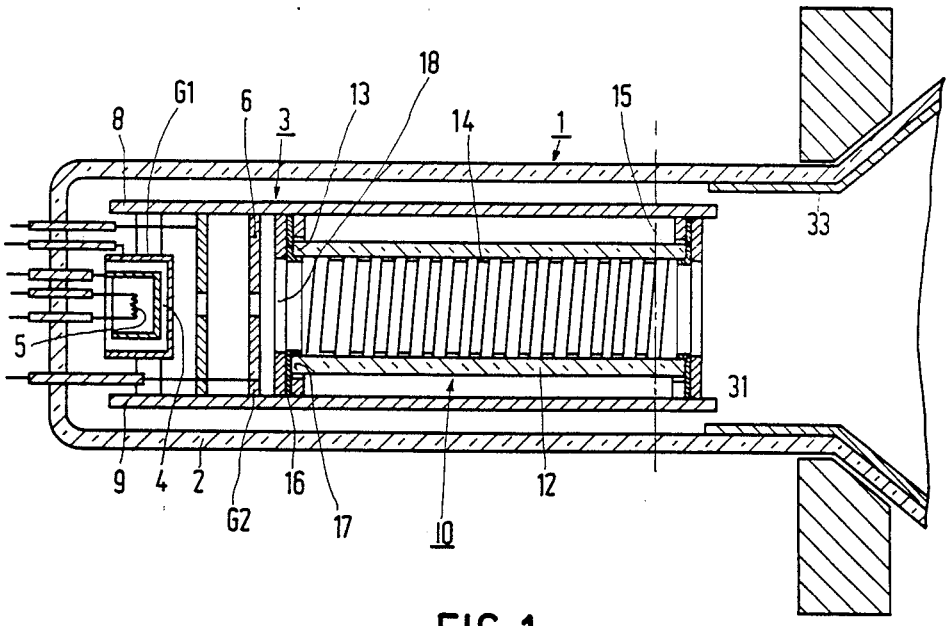
FIG. 1 is a diagrammatic cross-section of a cathode ray tube according to the invention including a gun having a focusing structure of the tubular type suspended in a special manner.

The constructive concept of the invention will be described in a general sense with reference to FIG. 1. FIG. 1 shows a cathode ray tube 1 comprising an electron gun 3 mounted in a neck portion 2. A G1 (grating) electrode structure is provided with a typical opening behind which a cathode 4 having an electron-emissive surface is arranged with an adjacent filament 5. A G2 electrode structure, in this case in the form of a metal plate 6 having a central opening, is arranged further to the front, adjacent to the G1 electrode structure. Still further arranged to the front is a G3 electrode structure in the form of a metal plate. For forming an assembly the electrode structures G1, G2 and G3, which constitute the beam-shaping part—in this case the (triode part)—of the gun, are secured to insulating mounting rods 8, 9 via pins (or brackets). In this case two mounting rods have been used. However, the invention is not limited thereto. Alternatively and conventionally, for example four or three mounting rods may be used. A focusing structure 10 comprises a hollow cylinder 12 which may be made of glass or a ceramic material and in this case its inner surface is coated with a layer of resistive material 14. In the relevant case the layer 14 has the shape of a helix. The cylinder 12 is fixedly connected at its end 13 to a flange 17 of a metal plate 16, which flange surrounds an opening 18 in the plate 16 and is secured via said metal plate 16 to the mounting rods 8, 9 to which also the beam-shaping part of the gun is secured. At its end 15 the cylinder 12 is secured in an analogous manner to the mounting rods 8, 9.

Materials having coefficients of expansion which are adapted to each other may be advantageously used for the hollow cylinder 12 and the metal plate 16. A suitable choice is, for example G28 glass for the hollow cylinder in combination with molybdenum or an iron-nickel-cobalt alloy for the plate, or lead glass or lime glass for the hollow cylinder in combination with FeCr for the plate.

Different techniques such as, for example thermal fusion high-frequency fusion (locally) can be used for connecting the (glass) hollow cylinder to the metal plate.

When using these techniques the temperatures should not be too high to prevent softening or deformation of the (glass) hollow cylinders as much as possible. This is important for obtaining a focusing structure which is free from aberrations to a maximum possible extent. For realising a focusing structure a layer of high-ohmic resistive material 14 is provided on the inner surface of the hollow cylinder 12. This layer may have the shape of one or more rings, or it may be in the form of a helix, or a combination of one or more rings with a helix. The layer of resistive material may be provided either before the metal plates are connected to the ends of the hollow cylinder, or after this operation. In the latter case it is ensured that the resistive layer is not exposed to the elevated temperatures occurring during the connection process. It is, for example possible to make very stable high-ohmic resistive layers by mixing $RuO_2$ or $RuCl_3$ particles with glass-enamel and by providing layers thereof on the inside of the neck of the tube by means of a suction technique. A resistive layer on the inner surface as contrasted to a resistive layer on the outer surface has the advantage that problems due to undefined charging of the inner wall cannot occur. During firing the glass-enamel melts and a high-ohmic conducting glass layer on the glass wall is obtained which is very stable and which does not change during processing of the tube.

A helical resistive layer can be made, for example by scratching, prior to firing, a helical interruption of the desired pitch in the powder layer on the glass wall by using a scriber. These layers have been found to be resistant to tube processing (fusing of the neck, aquadag firing, glass frit seal, exhaust process) and to socalled sparking of the tube.

An assembly step which is characteristic of the invention will be described in greater detail with reference to FIGS. 2 and 3.

To be able to use three helical lenses in a colour gun, one and three glass tubes, respectively, should be secured at each of their ends to a metal mounting plate. When making a glass-metal connection, the metal must be fusable and the coefficients of expansion of the glass and the metal must be equal. FeCr is suitable for the lead glass tubes in which the helical lenses are made, but this metal is magnetic, which is not always desirable in an electron gun. Furthermore deformation of the glass tube and providing and electrically connecting the helical resistor to external leads may be a problem.

Figure 2:
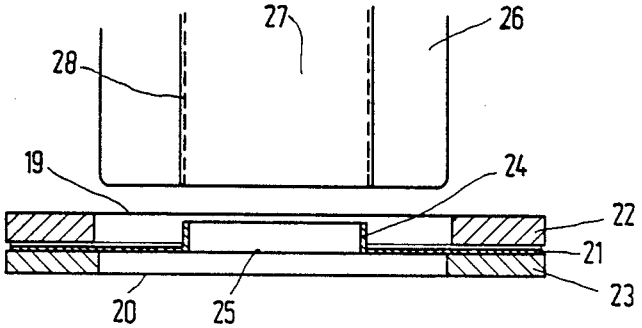
FIG. 2 is a diagrammatic cross-section of a suspension means to be used in the tube of FIG. 1.
Figure 3:
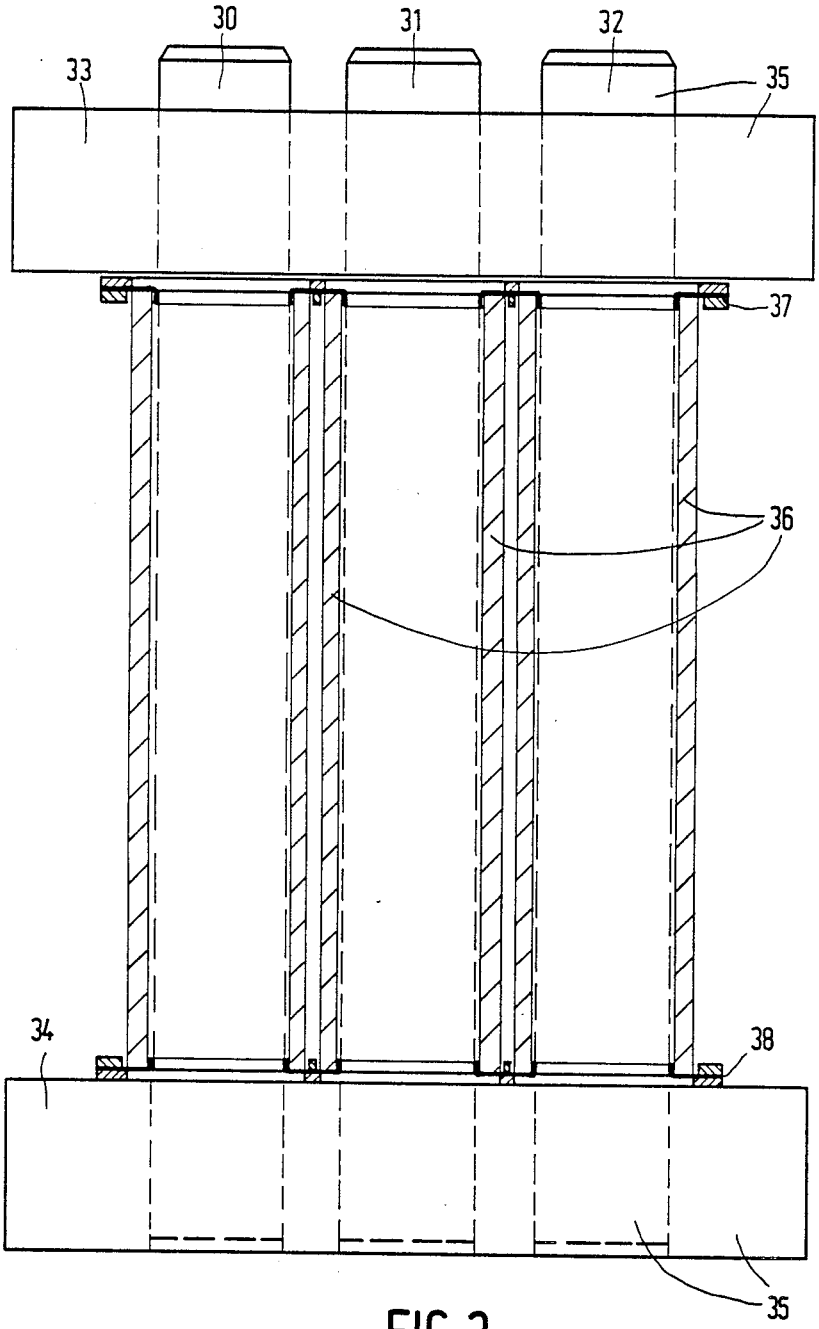
FIG. 3 is a diagrammatic cross-section of three focusing structures during their fixation to a suspension means of the type shown in FIG. 2.

The embodiment described with reference to FIGS. 2 and 3 provides a solution for securing ready-made glass tubes with helical lenses to non-magnetic connection plates in which also the helical resistor makes electrical contact with these connection plates. In this case use is made of a ductile aluminum foil which is fused to the conducting resistive layer and is used to eliminate the difference in expansion between the glass tube and (CrNi steel) connection plate.

As is shown in FIG. 2, a thin-walled aluminum plate (or foil) 21 is secured between a connection plate 22 and a supporting plate 23 by means of laser welding. The plates 22 and 23 which are made of, for example CrNi steel have facing coaxial openings 19, 20. A hole 25 is punched in the aluminum plate 21 via the openings 19, 20 and a flange 24 is drawn. A glass tube 26 having a high-ohmic resistive layer 28 based on glass-enamel on its inner surface 27 must be mounted on this flange 24. In the case of a colour gun the plates 22, 23 have three openings, while three holes are punched in the aluminum foil and three flanges are drawn, and three glass tubes must be mounted on the three flanges.

As is shown in FIG. 3, an assembly jig 35 comprising three mandrils 30, 31, 32 and two spacers 33, 34 are used for mounting the glass tubes. Three glass tubes 36 are slid on the mandrils 30, 31, 32 with two pairs of connection elements 37, 38 of the type shown in FIG. 2. The jig 35 with the tubes 36 is subsequently placed in a furnace and heated to a temperature at which the glass-enamel resistive layer on the inner side of the tube is fused to the flanges of the aluminum plates of the connection elements. After cooling and disassembly of the jig 35 a focusing electrode structure is obtained with three helical lenses which are accurately positioned relative to one another and whose ends are secured to connection elements with which they can be secured to mounting rods to which also the beam-shaping gun part is secured. The helical lenses also make electrical contact with the connection elements.

Figure 4:
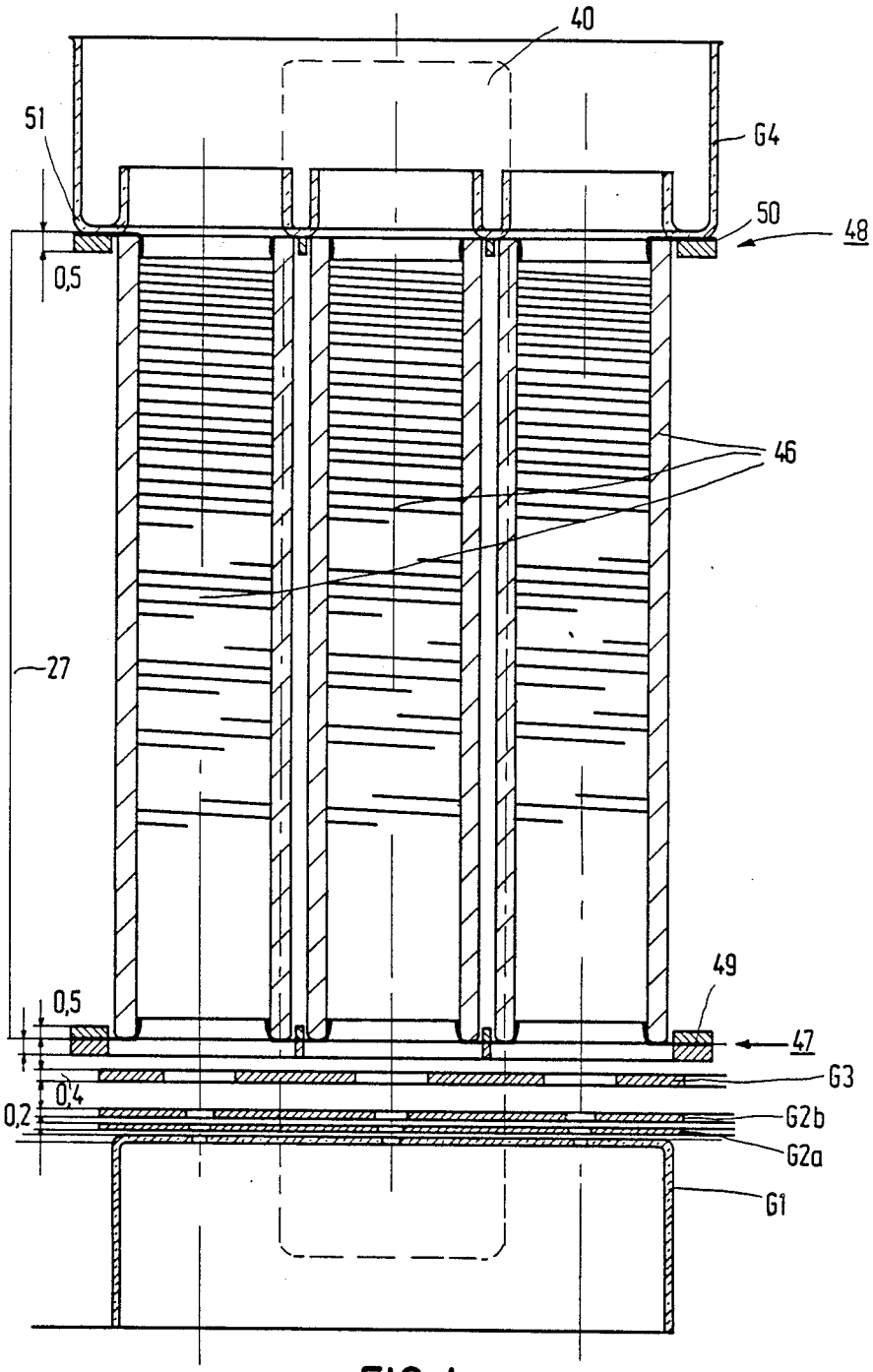
FIG. 4 is a diagrammatic cross-section of a colour gun suitable for a cathode ray tube according to the invention.
Figure 5:
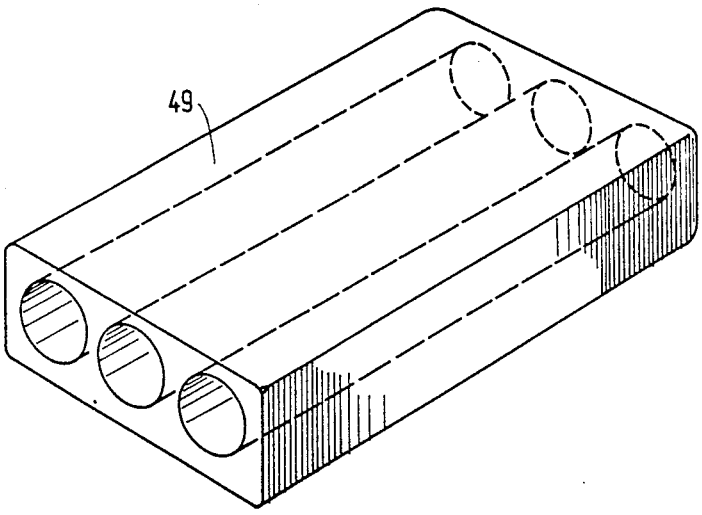
FIGS. 5 and 6 are perspective elevational views of tubes with three ducts for multiple focusing structures.
Figure 6:
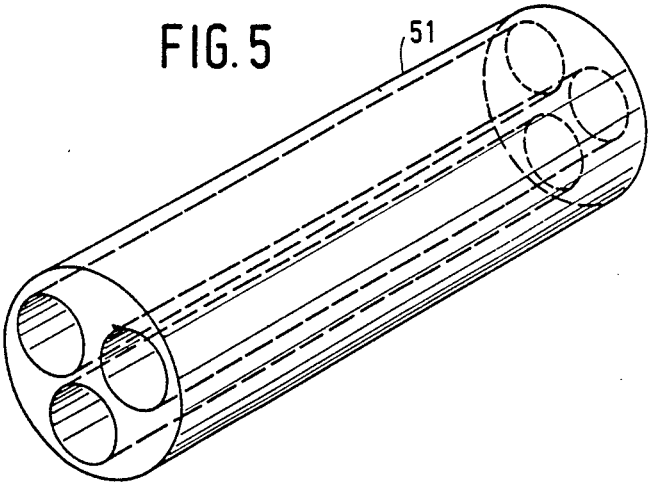

A colour gun thus manufactured is shown in FIG. 4. This gun comprises a beam-shaping part each having plate electrodes $G_1$, $G_{2a}$, $G_{2b}$ and $G_3$ provided with three openings, which are secured to two diametrically arranged mounting rods (of which only mounting rod or multi-form 40 is shown by means of a broken line). Three glass tubes 46 comprising a helical lens provide a focusing structure. On the side of the beam-shaping gun part the tubes 46 are connected to a connection element 47 which comprises two metal plates and an aluminum foil 49 having openings with flanges and being provided between these plates. The flanges are fused to the glass-enamel resistive layers in which the helical lens configurations are formed. On the side remote from the beam-shaping gun part the tubes 46 are connected to a connection element 48. This connection element is essentially identical to connection element 47, on the understanding that in the case shown one of the two metal plates between which the aluminum foil (here foil 50) is secured is formed by the bottom 51 of the G4 electrode. In this case the bottom 51 has three openings surrounded by collars, but the invention is not limited to such a G4 configuration. In a gun of the in-line type (FIG. 3) the cylinder structures are co-planar and in a gun of the delta type the cylinder structures should be positioned in accordance with a triangular arrangement. In both cases (glass or ceramic) rods 49, 51 having three internal ducts (FIG. 5; FIG. 6) instead of separate hollow cylinders may alternatively be used.

We claim:

1. A cathode ray tube having an envelope comprising a phosphor screen on one side and a neck portion on the other side, and an electron gun which is positioned in the neck portion and has a beam-shaping part and a focusing structure, said beam-shaping part comprising a cathode and at least one metal electrode, and said focusing structure comprising a hollow tube which is open at both ends and is made of an electrically insulating material with a layer of high-ohmic resistive material on the inner surface, characterized in that the components of the beam-shaping part of the electron gun, together with the hollow tube are secured via metal supporting elements to at least two axial mounting rods, the tube being fixedly connected at each of its end faces to a metal plate having a coaxial opening which is provided with a flange projecting into the hollow tube.

2. A cathode ray tube as claimed in claim 1, characterized in that the flanges of the metal plates are secured to the inner surface of the hollow tube by means of a glass-enamel.

3. A cathode ray tube as claimed in claim 2, characterized in that the high-ohmic resistive layer on the inner surface of the hollow tube comprises a glass-enamel with an electric resistive material and in that the flange of at least one of the metal plates is secured to the inner surface of the tube by means of said glass-enamel.

4. A cathode ray tube as claimed in claim 2 or 3, characterized in that the metal plates are manufactured of a thin-walled material.

5. A cathode ray tube as claimed in claim 4, characterized in that the thin-walled material substantially comprises aluminum or an aluminum alloy.

6. A cathode ray tube as claimed in claim 4, characterized in that each metal plate of thin-walled material is mounted between a connection plate and a supporting plate, which plates have openings arranged coaxially with the opening in the relevant metal plate, the flange around the opening of the metal plate projecting through the opening in the supporting plate, and the connection plate being secured to the mounting rods.

7. A cathode ray tube as claimed in claim 6, characterized in that each metal plate of thin-walled material is mounted between the supporting plate and the connection plate by means of laser welding.

8. A cathode ray tube as claimed in claim 1, characterized in that the beam-shaping part of the electron gun is intended to produce three electron beams and in that each beam has its own focusing structure.

9. A cathode ray tube as claimed in claim 8, characterized in that each of the three focusing structures comprises a tube of an electrically insulating material.

10. A cathode ray tube as claimed in claim 8, characterized in that the three focusing structures are accommodated in one tube with three internal ducts.

* * * * *